United States Patent [19]

Wind

[11] 4,028,004

[45] June 7, 1977

[54] FEATHERING CONTROLLABLE PITCH PROPELLER

[75] Inventor: Jaap Wind, Waalwijk, Netherlands

[73] Assignee: Lips B.V., Drunen, Netherlands

[22] Filed: July 1, 1975

[21] Appl. No.: 592,261

[30] Foreign Application Priority Data

July 3, 1974 United Kingdom ..... 29494/74

[52] U.S. Cl. ..... 416/157 R; 416/49

[51] Int. Cl.² ..... B63H 3/08

[58] Field of Search ..... 416/49, 50, 157, 48, 416/157 A, 157 B

[56] References Cited

UNITED STATES PATENTS

| | | | |
|---|---|---|---|
| 1,723,617 | 8/1929 | Hele-Shaw et al. | 416/157 |
| 2,333,973 | 11/1943 | Beebe | 416/49 X |
| 2,664,960 | 1/1954 | Longfellow et al. | 416/49 X |
| 2,809,702 | 10/1957 | Lambeck et al. | 416/50 X |
| 2,955,663 | 10/1960 | Brandes et al. | 416/49 X |
| 2,959,156 | 11/1960 | Dreptin | 416/157 |
| 3,003,566 | 10/1961 | Conn et al. | 416/49 X |
| 3,051,248 | 8/1962 | Hatcher | 416/157 |
| 3,263,754 | 8/1966 | Belliere | 416/157 |
| 3,459,267 | 8/1969 | Chilman | 416/157 |
| 3,527,186 | 9/1970 | Wennberg et al. | 416/157 X |
| 3,528,752 | 9/1970 | Davies et al. | 416/157 X |
| 3,690,788 | 9/1972 | Pedersen | 416/157 |
| 3,711,221 | 1/1973 | Almqvist | 416/49 X |
| 3,778,187 | 12/1973 | Wennberg | 416/157 X |
| 3,802,800 | 4/1974 | Merky et al. | 416/157 |
| 3,895,598 | 7/1975 | Blickle | 416/157 X |

FOREIGN PATENTS OR APPLICATIONS

| | | | |
|---|---|---|---|
| 720,239 | 10/1965 | Canada | 416/49 |
| 954,911 | 1/1950 | France | 416/157 |
| 1,112,411 | 3/1956 | France | 416/49 |
| 1,153,266 | 3/1958 | France | 416/157 |
| 1,260,746 | 4/1961 | France | 416/49 |

*Primary Examiner*—Everette A. Powell, Jr.
*Attorney, Agent, or Firm*—Young & Thompson

[57] ABSTRACT

A controllable pitch marine propeller has blades carried by a hub and a hydraulic actuator housed in the hub and coupled to the blades for altering the pitch angle of the blades in both directions, astern and ahead, and also beyond the ahead position to a feathered position. A servo-control system controls the actuator to adjust the blade pitch angle, the control system having a blade position feedback loop by which the system operates with positional feedback over the range of pitch angle between astern and full ahead pitch angles. However, the demand signal for blade feathering renders the feedback loop inoperative, and the hydraulic actuator then moves the blades into the feathering position without feedback action.

5 Claims, 8 Drawing Figures

FEATHERING CONTROLLABLE PITCH PROPELLER

Figure 7:
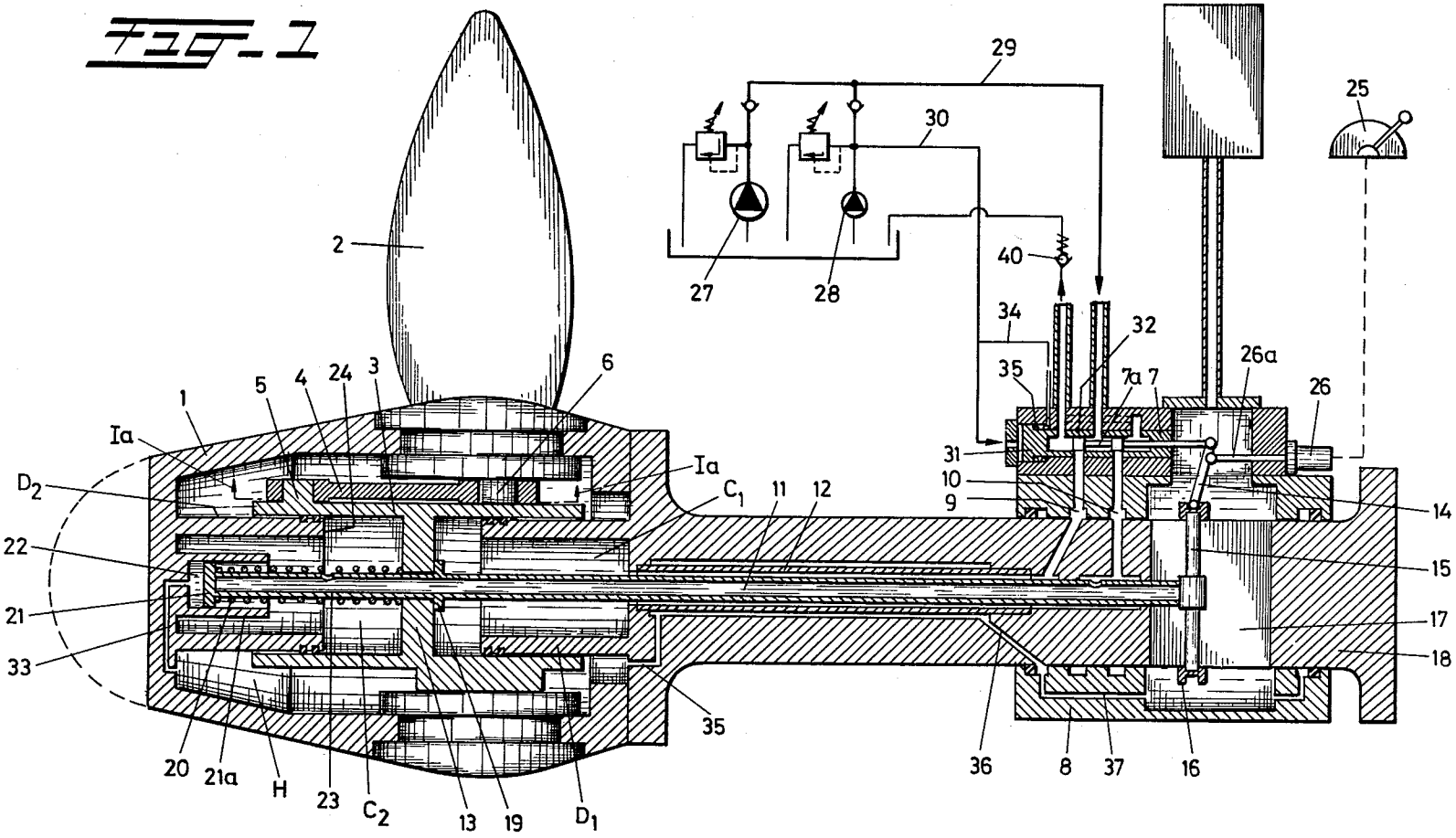

This invention relates to a controllable-pitch marine screw propeller, of the kind wherein the pitch of the propeller blades can be changed through a range extending from a certain astern pitch angle, through neutral and a certain full-ahead pitch angle, to 90° ahead pitch, known as the feathering position, in which the blades are generally parallel to logitudinal axis of symmetry of the ship. The feathering position of blades is utilised for certain ships with more than one propulsion equipment, in order to reduce the ship's resistance in the water when one or more propellers are working and other propellers are stopped.

Propellers of the feathering kind have a larger pitch angle range, which is at least 105° , as compared to ordinary controllable-pitch propellers, wherein the pitch is usually controlled over not more than 50° , and therefore the length of the travel made by the pitch control mechanism in the hub of a feathering propeller is about twice as much as in an ordinary controllable-pitch propeller.

A disadvantage of known feathering propellers operated by hydraulic means is that for feedback of the blade position the same large travel must be made in the controlling pressure fluid distribution unit inside the ship, which leads to the construction of oil distribution units of extreme length.

One object of the present invention is an improved arrangement and mechanism in the hub which avoids this disadvantage. A further object of the invention is to provide means for safe operation of the feathering position which will prevent damage due to overtorque, either to the propeller or the propeller shaft or to the engine that drives the propeller shaft.

According to the present invention, a controllable-pitch marine porpeller of the kind specified having a hydraulic actuator housed in its hub and coupled to the blades for altering the blade pitch in both directions in the said range, is combined with a servo control system for controlling the actuation to adjust the blade pitch angle, the control system having a blade position feedback loop and being so constructed and arranged that the system operates with positional feedback over the range of pitch angle between astern and full-ahead pitch angles, but that the feedback loop is automatically rendered inoperative in response to a demand signal for blade feathering whereby the actuator then moves the blades into the feathering position without feedback action in response to the said demand signal.

The feedback loop may include a mechanical link constituted by a fluid supply pipe longitudinally-movably mounted in a bore in the propellor shaft, to supply pressure fluid to the actuator, the oil supply pipe having an end stop arranged to engage a fixed abutment to render the feedback loop inoperative when the actuator adjusts the blade pitch angle beyond the full-ahead position. For example the fluid supply pipe may be mechanically coupled to the movable member of the actuator through a resiliently-biased lost-motion.

In one arrangement of the invention the servo control system is a hydraulic system having a hydraulic servo valve, a main pressure-fluid supply pump and an auxiliary pressure-fluid supply pump, the servo valve having a displaceable ported liner in its valve housing, in which liner the movable valve slides, and in which the auxiliary pump energised causes the displacement of the liner to open the valve and energise the actuator to move the blades into the feathering positin, thereby rendering the feed back loop inoperative. In this case, it is the switching on of the auxiliary pump that constitutes the demand signal for blade feathering.

Figure 1D:
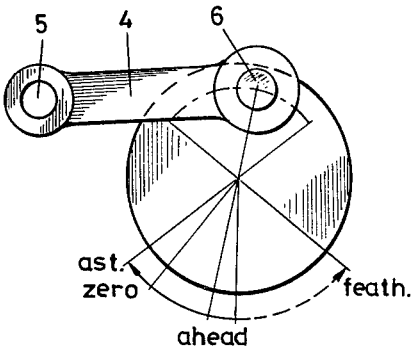
Figure 2D:
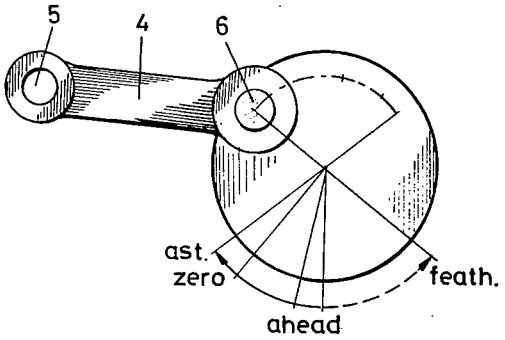
Figure 1B:
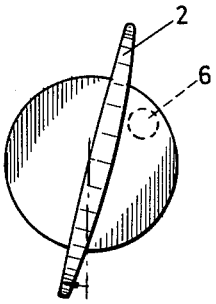
Figure 1C:
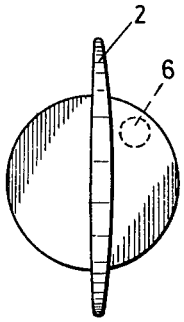
Figure 1D:
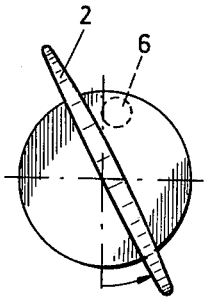
Figure 1E:
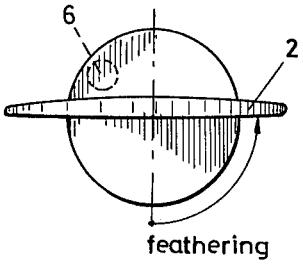
Figure 2:
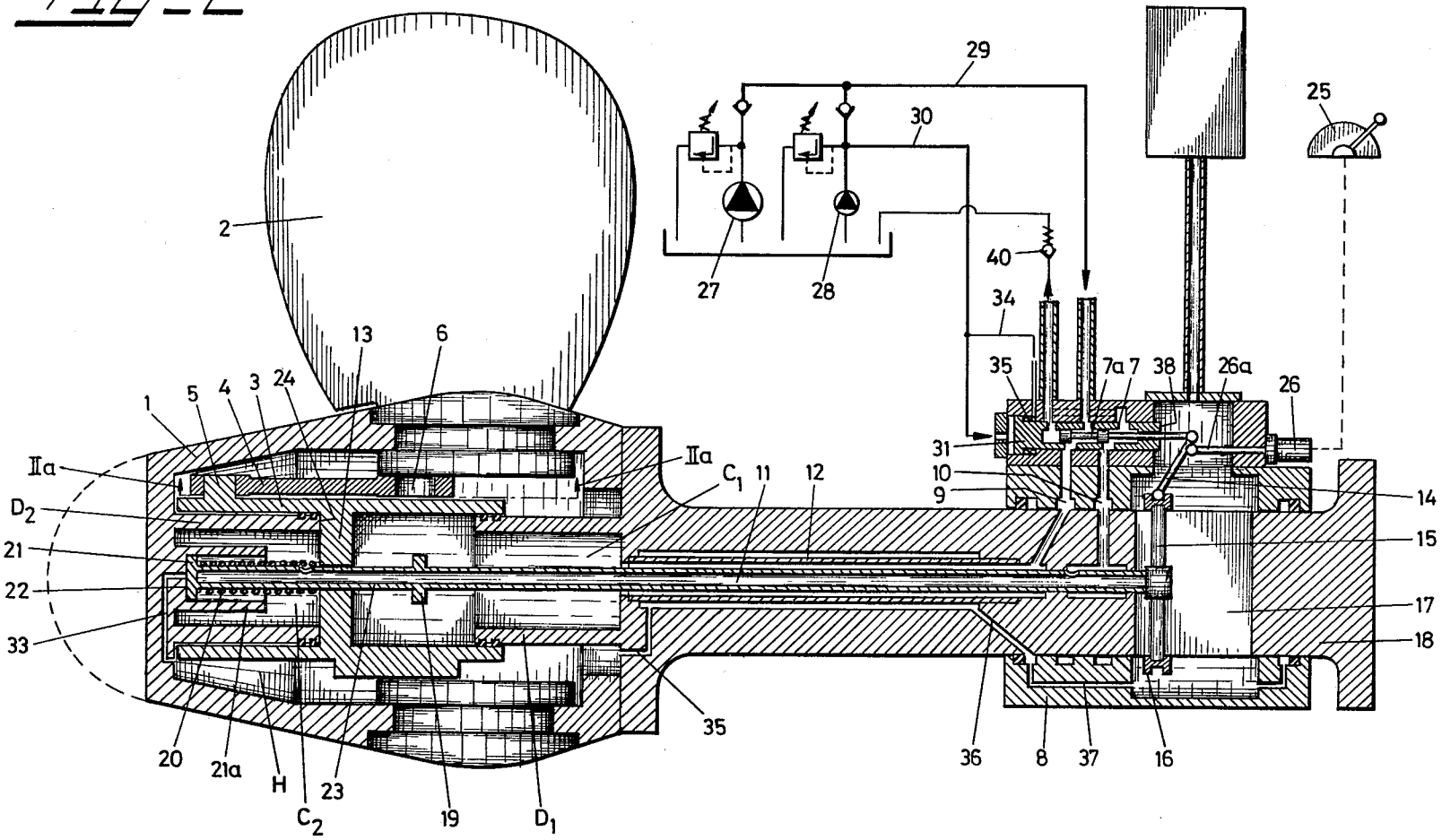

The invention may be carried into practice in various ways, but one specific embodiment will now be described by way of example and with reference to the accompanying drawings, in which:

FIG. 1 is an axial sectional view of a controllable pitch propeller system embodying the invention, in which the blades are shown in a normal ahead pitch position;

FIG. 1*a* is a section taken on the line I*a*–I*a* in FIG. 1 showing the crank-connecting rod mechanism which is used for turning each blade from full astern pitch, through the zero pitch or neutral position, through full ahead pitch position to the feathered position, and vice-versa;

FIG. 1*b* shows a blade section in the full astern pitch;

FIG. 1*c* shows a blade section in zero or flat pitch, i.e. the neutral position;

FIG. 1*d* shows a blade section in free running ahead pitch;

FIG. 1*e* shows a blade section in the feathering position;

FIG. 2 is an axial sectional view of the controllable pitch propeller of FIG. 1 showing the blades and all parts in the feathering condition; and FIG. 2*a* is a section on the line II*a*—II*a* in FIG. 2, corresponding to FIG. 1*a*, showing the mechanism in the feathering position.

In the illustrated embodiment a controllable-pitch propeller comprises a hub 1, and a plurality of rotatable blades 2. A movable hydraulic actuating cylinder 3 with oil compartments $C_1$ and $C_2$ is linked to the blades 2 by means of connecting rods 4 whose opposite ends are respectively pivoted to pivot pins 5 on the cylinder 3 and eccentric crank pins 6 on the blade axles. Oil flow to and from the cylinder compartments $C_1$ and $C_2$ is controlled by a distribution valve 7 located in the oil distribution unit 8. Oil is forced under pressure into the rotating propeller shaft 18 through either of two channels 9 or 10 selected by the valve 7, and is supplied to and from the cylinder 3 via oil pipes 11 and 12, concentrically arranged in the hollow propeller shaft 18. The oil pipe 12 is axially stationary but the pipe 11 is connected to the central wall 13 of the moving actuating cylinder 3 in the hub and provides feedback of the blade position into a pivoted link 14, through a spoke 15 and ring 16. The spoke 15 travels in a slot 17 in the propeller shaft 18 and moves simultaneously and in unison with the cylinder 3, which slides on fixed pistons D1 and D2. The link 14 pivotally interconnects the ring 16, the remote control operating rod 26A and the movable member 7A of the valve 7 for differential movement.

This mode of control using a feedback loop, is applied for normal operation of the blades between astern and ahead pitch, see FIGS. 1*b*–1*d*.The oil pipe 11 is provided with a collar 19 which can be pressed against the central wall 13 of the cylinder 3 by a spring 20, the right-hand end of which spring as seen in FIG. 1 bears against the left side of the central wall 13 and the left end of which bears against a piston 21 carried by the left-hand end of the movable pipe 11. The piston 21 slides in a small cylinder 21A within the oil compartment $C_2$, the left-hand end of he cylinder 21A being connected by a passage 33 to the hub interior H outside the compartment $C_2$. The pressure in the cylinder compartment $C_2$ is always kept higher than the pressure in the hub compartment H by means of a valve 40 in the hydraulic return line from the control valve 7. So the differential pressure across the piston 21 presses the collar 19 firmly aganist the cylinder wall 13, thus forming a rigid abutment between the pipe 11 and the cylinder 3.

It will be seen, however, that when the cylinder 3 passes farther leftwards beyond the ahead position, the piston 21 will be stopped by abutting against hub-cover 22, see FIG. 2. The collar 19 of pipe 11 is disconnected from the wall 13 and the cylinder 3 slides over part 23 of pipe 11 until the cylinder 3 is stopped by end stop 24, which corresponds to the feathered position, FIG. 1*e*. For safety reasons this action is not within reach of the normal remotecontrol system indicated at 25, 26.

To bring the blades from the ahead position into the feathered position, the main hydraulic pump 27 must be stopped. A smaller auxiliary pump 28 is then switched on and pressurizes the distribution valve 7 (via the usual line 29) and, via the line 30, acts on a piston 31 on the valve liner 32; the piston 31 displaces the valve liner 32 in the body of the valve 7, opening the valve so that oil is forced via the lines 29 and 9 to cylinder compartment $C_1$. As soon as the piston 21 touches the hub cover 22, the feedback is made inoperative and the cylinder 3 proceeds automatically to the feathered position.

FIG. 2 shows the position of the blades 2, the cylinder 3 and the parts 11, 15, 16 and 30 in the feathered situation. The stroke of the spoke 15 in the slotted shaft 18 is about half the travel of the cylinder 3 in the hub 1, so that a standard size servo control unit 7 of normal length can be used, comparable to servo units for non-feathering controllable pitch propellers.

As mentioned, in the hub cover 22 a passage 33 is present connecting the hub compartment H with the chamber $C_2$ at the leftside of the piston 21. Without this passage 33 the oil would be trapped in this operating chamber of the piston 21. The hub compartment H is connected by a passage 35 to the annular space in the propeller shaft 18 around the fixed pipe 12, this space being connected by passages 36, 37 to the slot 17 and thence back to the oil reservoir.

There is also provided a line 34 between the auxiliary pump 28 and the right-hand side of the piston 31. The piston 31 moves to the right against the action of a spring 35, if oil pressure is supplied via the line 30. The force resulting from the oil pressure supplied via the line 34 to the right side of the pistion 31 assists the spring 35, but is overcome by the force of the oil pressure supplied via the line 30 to the left-hand side of the piston 31 which is of greater area. However, the piston 31 will be returned to the left by the spring 35 without difficulty if the pump 28 is switched off.

Thus in the region between astern pitch, for instance −15°, through zero pitch to full ahead pitch, for instance +25°, the feedback system is used normally, with the pump 27 switched on and the pump 28 switched off. If the normal remote control system 25, 26 is adjusted, for instance to +25°, the blades 2 will be turned to the corresponding full-ahead pitch position.

When this full-ahead pitch is reached (or at any earlier demanded pitch angle), the oil supply to the oil compartment $C_1$ is closed, since the distribution valve 7 recloses the channel 9 under the operation of the feedback mechanism. This is the normal mode of operation.

However, if it is necessary to adjust the blades into the feathered position, i.e. +90°, the main oil pump 27 is switched off and the auxiliary pump 28 is switched on. Now the valve liner 32 is moved to the right as shown in FIG. 2, so that the pump 28 can supply oil to the compartment $C_1$, until the feathered position is reached. During the travel from for instance +25° to +90° the slide 7*A* of the distribution valve 7 is not moved by the feedback mechanism, which remains stationary. Thus the normal control is not affected.

What we claim is:

1. A controllable-pitch marine propeller having blades carried by a hub and having a hydraulic actuator housed in the hub and coupled to the blades for altering the blade pitch angle in both directions, and a servo control system for controlling the actuator to adjust the blade pitch angle, the control system having a blade position feedback loop by which the system operates with positional feedback over the range of pitch angle between astern and fullahead pitch angles, and means to render the feedback loop inoperative in response to a demand signal for blade feathering whereby the actuator then moves the blades into the feathering position without feedback action in response to the said demand signal, said feedback loop including a mechanical link constituted by a fluid supply pipe longitudinally-movably mounted in a bore in the propeller shaft, to supply pressure fluid to the actuator, the oil supply pipe having an end stop arranged to engage a fixed abutment to render the feedback loop inoperative when the actuator adjusts the blade pitch angle beyond the full-ahead position.

2. Apparatus as claimed in claim 1 in which the fluid supply pipe is mechanically coupled to the movable member of the actuator through a resiliently-biassed lost-motion connection.

3. Apparatus as claimed in claim 2 which the fluid supply pipe carries a collar fixed with respect to the pipe and arranged to be held resiliently abutted against the movable member of the actuator for movement therewith by means of a spring.

4. Apparatus as claimed in claim 2 in which said lost-motion connection resiliently biases the fluid supply pipe into abutting engagement with the movable member of the actuator for movement therewith upon differential hydraulic pressure acting on a piston carried by the pipe.

5. Apparatus as claimed in claim 1 in which the servo control system is a hydraulic system having a hydraulic servo valve, a main pressure-fluid supply pump and an auxiliary pressure-fluid supply pump, the servo valve having a displaceable ported liner in its valve housing, in which liner the movable valve member slides, and in which the auxiliary pump when energised causes the displacement of the liner to open the valve and energise the actuator to move the blades into the feathering position, thereby rendering the feedback loop inoperative.

* * * * *